US006569242B2

(12) United States Patent
Miyai et al.

(10) Patent No.: US 6,569,242 B2
(45) Date of Patent: May 27, 2003

(54) THERMAL SPRAYING SYSTEM FOR CYLINDER

(75) Inventors: Kenji Miyai, Hamamatsu (JP); Seiya Kunioka, Hamamatsu (JP); Tadashi Takahashi, Hamamatsu (JP); Manabu Suzuki, Hamamatsu (JP); Hirotoshi Ohishi, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 44 days.

(21) Appl. No.: 09/886,568

(22) Filed: Jun. 21, 2001

(65) Prior Publication Data

US 2001/0054654 A1 Dec. 27, 2001

(30) Foreign Application Priority Data

Jun. 21, 2000 (JP) ..... 2000-185542

(51) Int. Cl.[7] ..... B05C 11/02
(52) U.S. Cl. ..... 118/55; 118/318; 118/326
(58) Field of Search ..... 427/425, 233; 118/55, 306, 318, 320, 317, 326; 29/888.061

(56) References Cited

U.S. PATENT DOCUMENTS

| | | | | |
|---|---|---|---|---|
| 3,741,149 A | * | 6/1973 | Gerlovich | 118/317 |
| 4,150,164 A | * | 4/1979 | Gerek et al. | 427/181 |
| 5,954,908 A | * | 9/1999 | Amo et al. | 118/500 |

FOREIGN PATENT DOCUMENTS

| | | |
|---|---|---|
| JP | 59-6188 | 1/1979 |
| JP | 54003609 A | 1/1979 |

* cited by examiner

*Primary Examiner*—Richard Crispino
*Assistant Examiner*—Michelle Aewedo Lazor
(74) *Attorney, Agent, or Firm*—Alston & Bird LLP

(57) ABSTRACT

A thermal spraying system for a cylinder, in which a cylinder is held on a turntable; a bore inside surface of said cylinder is subjected to thermal spraying by moving a thermal spraying gun in the axial direction in the bore of said cylinder while said cylinder is rotated; a suction port of a dust discharge pipe for sucking dust in the bore of said cylinder is disposed under said cylinder to suck and discharge dust in the bore of said cylinder; and the diameter of the suction port of said dust discharge pipe is larger than the inside diameter of the bore of said cylinder.

4 Claims, 11 Drawing Sheets

THERMAL SPRAYING SYSTEM FOR CYLINDER

BACKGROUND OF THE INVENTION

The present invention relates to a thermal spraying system for a cylinder and, more particularly, to a thermal spraying system for a cylinder, which carries out thermal spraying on the bore inside surface of a cylinder by holding the cylinder on a turntable and by moving a thermal spraying gun in the axial direction in the bore of the cylinder while the cylinder is rotated.

In thermal spraying for a cylinder in mass production, to form a deposit while dust is sucked from the lower face of bore by using the dust discharge pipe is an important technology in terms of prevention of dust from being entrained in the deposit. However, unless measures are taken against accumulation of spray deposit on the connecting jig and the dust discharge pipe connecting portion (suction port), the deposit accumulating on the connecting jig and the dust discharge pipe suction port degrades the property of deposit formed on the inside surface of a cylinder, or results in the peeling-off of the deposit.

SUMMARY OF THE INVENTION

The present invention has been made in view of the above situation, and accordingly an object thereof is to provide a shape of a dust discharge pipe suction port and constructions of a dust discharge pipe and the suction port thereof which are less liable to permit a spray deposit to accumulate to accomplish thermal spraying of cylinders continuously, and to provide a thermal spraying system for a cylinder which is suitable for mass production of cylinders to accomplish thermal spraying of cylinders continuously.

Specifically, in accordance with the present invention there is provided a thermal spraying system for a cylinder, in which a cylinder is held on a turntable;

a bore inside surface of said cylinder is subjected to thermal spraying by moving a thermal spraying gun in the axial direction in the bore of said cylinder while said cylinder is rotated;

a suction port of a dust discharge pipe for sucking dust in the bore of said cylinder is disposed under said cylinder to suck and discharge dust in the bore of said cylinder; and the diameter of the suction port of said dust discharge pipe is larger than the inside diameter of the bore of said cylinder.

According to the thermal spraying system for a cylinder in accordance with the present invention, the flow of spray flame and dust is discharged smoothly without being obstructed by the dust discharge pipe, and spray flame is blocked by the lower end inside surface of the cylinder bore, so that a deposit is not formed on the suction port of the dust discharge pipe. Therefore, the spray deposit on the lower end inside surface of the cylinder bore and the spray deposit on the suction port of dust discharge pipe do not connect with each other, and also when a cylinder having been subjected to thermal spraying is removed from the dust discharge pipe, there is no fear of damaging the spray deposit on the lower end inside surface of the cylinder bore.

It is advantageous an angle between the center axis of spray flame injected from said thermal spraying gun and said dust discharge pipe is 45 degrees or less.

With this feature, a spray deposit is prevented from adhering to the dust discharge pipe to the utmost. Therefore, the dust discharge pipe need not be replaced, so that a mass production effect can be achieved, and also a stable spray deposit can be formed.

It is also advantageous that said dust discharge pipe is divided into a rotating portion and a fixed portion, and said rotating portion is held integrally with said turntable and is inserted in said fixed portion with a gap therebetween.

With these features, since the dust discharge pipe is rotated, the flame does not hit only a part of the dust discharge pipe. Therefore, the dust discharge pipe is prevented from being melted by the spray flame, and the spray deposit is formed so as to be distributed on the inside surface of the dust discharge pipe, so that the deposit forming speed is low, and the flow of dust discharge is not obstructed. Also, since the dust discharge pipe is held integrally with the turntable, special power for rotating the dust discharge pipe is not needed. Further, since the rotating portion of the dust discharge pipe is inserted in the fixed portion with a gap therebetween, and a bearing or the like need not be provided, there is no need for taking measures to protect the bearing or the like against heat.

It is also advantageous that a rotating shaft of said turntable is formed of a tube, and said dust discharge pipe is disposed in said rotating shaft with a gap therebetween.

With these features, since the dust discharge pipe and the rotating shaft of turntable are disposed with a gap therebetween, heat of the dust discharge pipe is scarcely transmitted to the rotating shaft of turntable, so that grease for a bearing or the like for holding the rotating shaft of turntable, sealing portion, and the like are not influenced thermally, whereby the durability is enhanced.

It is also advantageous that said cylinder is fixed to a pallet, said pallet is conveyed and fixed to said turntable;

said cylinder is rotated together with said pallet;

U-shaped rails for guiding said pallet are provided in parallel above said turntable so as to be movable vertically; and pins are erected on said turntable and holes are formed in said pallet;

so that said pallet to which said cylinder is fixed is guided by said U-shaped rails and said U-shaped rails are lowered to fit the holes formed in said pallet on said protrusions provided on said turntable;

whereby said cylinder is positioned and locked on said turntable.

With these features, the construction is simple, the maintainability is high, and excellent durability is obtained. Moreover, the cylinder can easily be positioned and locked on the turntable, and also even if the power such as air is shut off during the rotation of turntable, the pallet is not unclamped.

BRIEF DESCRIPTION OF THE DRAWINGS

A thermal spraying system for a cylinder in accordance with the present invention will now be described with reference to the accompanying drawings.

DETAILED DESCRIPTION OF THE PREFERRED EMBODIMENT

Figure 1:
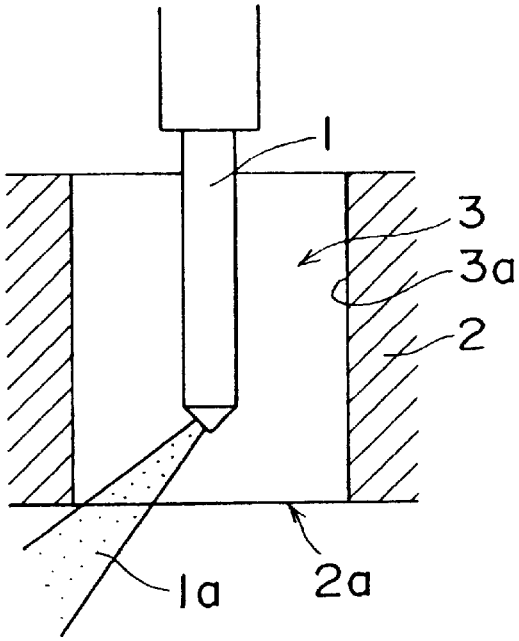
FIG. 1 is a schematic sectional view showing a positional relationship between a cylinder bore and spray flame in a thermal spraying system for a cylinder.
Figure 2:
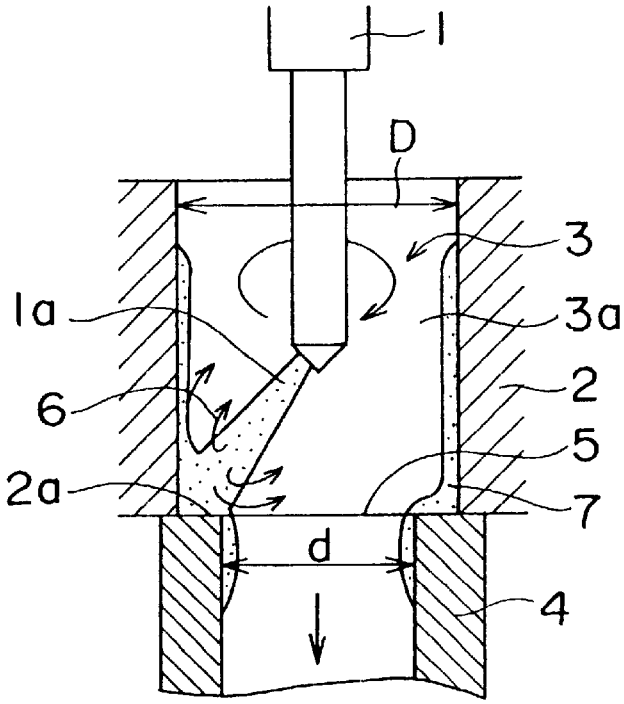
FIG. 2 is a schematic sectional view showing a positional relationship between a lower end of a cylinder bore and a suction port of dust discharge pipe in a thermal spraying system for a cylinder and a state of spray deposit formed near the lower end of the cylinder bore.
Figure 3:
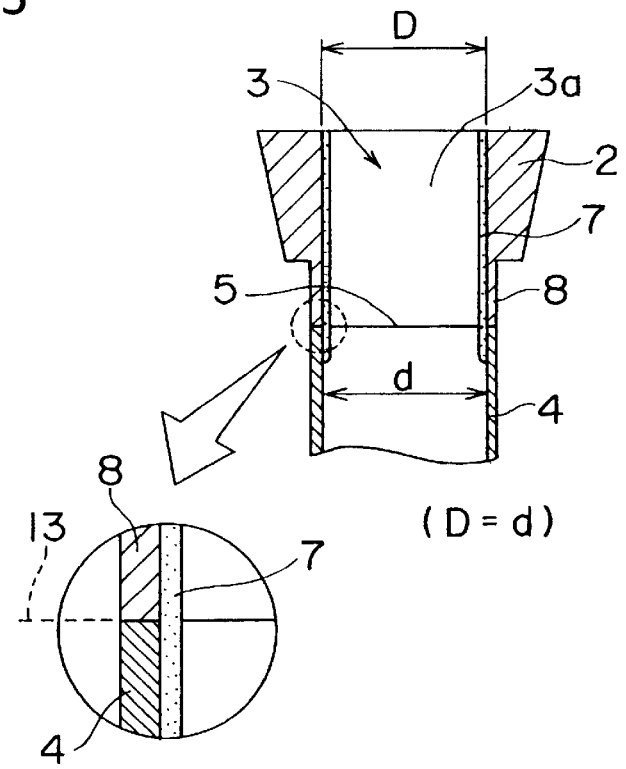
FIG. 3 is a schematic sectional view showing a state of spray deposit formed when the inside diameter of a cylinder bore is equal to the inside diameter of the suction port of the dust discharge pipe in a thermal spraying system for a cylinder.
Figure 4:
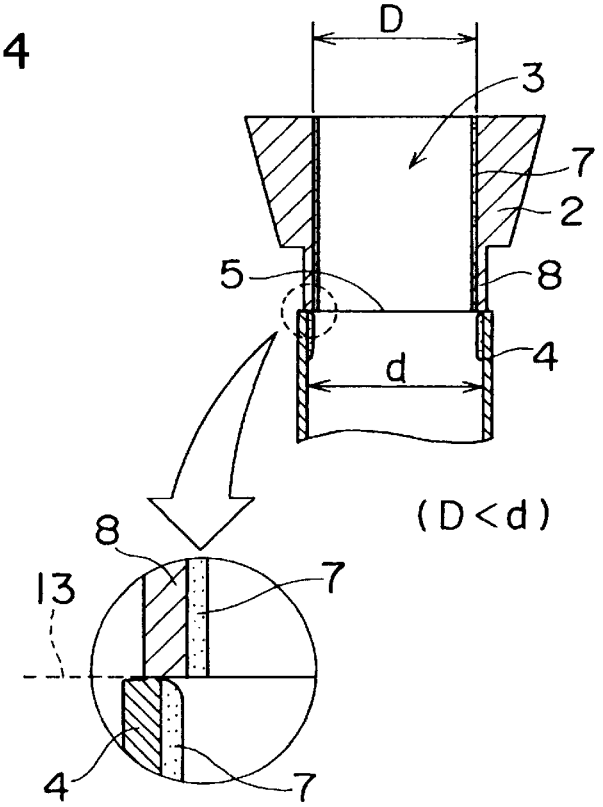
FIG. 4 is a schematic sectional view showing a positional relationship between a lower end of a cylinder bore and a suction port of a dust discharge pipe in a thermal spraying system for a cylinder in accordance with the present invention and a state of spray deposit formed near the lower end of the cylinder bore.

Relationship Between Dust Discharge Pipe Suction Port and Cylinder Bore Inside Diameter:

As shown in FIG. 1, in thermal spraying of a cylinder, in order to form a spray deposit with a given thickness on the inside surface of a cylinder 2, flame 1*a* injected from a thermal spraying gun 1 is applied to under a lower end face 2*a* of the cylinder 2. At this time, if as shown in FIG. 2, an inside diameter d of a suction port 5 of a dust discharge pipe 4 is smaller than an inside diameter D of a cylinder bore 3, the flow of the flame 1*a* having thermal sprayed a cylinder bore inside surface 3*a* and dust are obstructed by the suction port 5, so that spit-back 6 occurs, which causes a turbulent flow in the bore 3. Thereby, dust is entrained in a spray deposit 7 formed on the cylinder bore inside surface 3*a*, so that the deposit property is degraded. Also, the deposit 7 accumulates on the suction port 5 of the dust discharge pipe 4, and the accumulating deposit 7 grows to connect with the deposit 7 on the bore inside surface 3*a*. Therefore, when the cylinder 2 is removed, the deposit 7 is peeled off. As shown in FIG. 3, the connection of the deposit 7 also occurs when the diameter d of the dust discharge pipe suction port 5 is equal to the inside diameter D of the cylinder bore 3. Therefore, as shown in FIG. 4, the diameter d of the dust discharge pipe suction port 5 must be made larger than the inside diameter D of the cylinder bore 3 to prevent the connection of the deposit 7.

Shape of Dust Discharge Pipe Suction Port:

In the thermal spraying process, the accumulation of the deposit 7 on the suction port 5 of the dust discharge pipe 4 is inevitable. However, it was found that by considering the shape of the dust discharge pipe suction port 5 with respect to the spray flame 1*a*, the quantity of accumulation of the deposit 7 can be decreased, and the adhesive force can be weakened, by which the thermal spraying system can be used in mass production.

Figure 5:
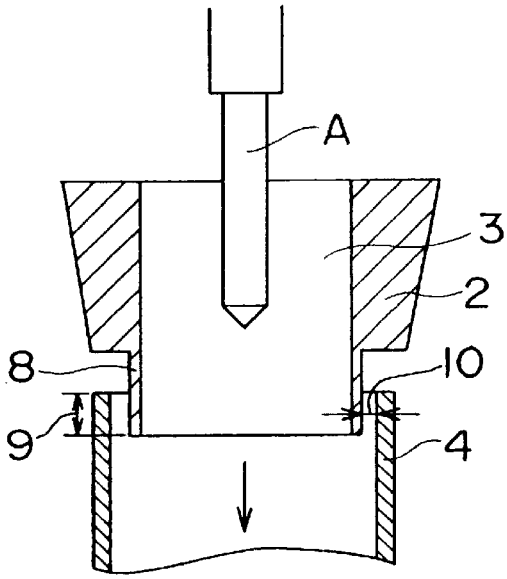
FIG. 5 is a schematic sectional view showing one example of a connection state of a lower end of a cylinder bore and a suction port of a dust discharge pipe in a thermal spraying system for a cylinder in accordance with the present invention.

Manner for Connecting Dust Discharge Pipe to Cylinder:

As shown in FIG. 5, a cylinder skirt 8 is preferably inserted in the dust discharge pipe 4. The insertion length 9 may be about 10 mm. In the case where the insertion length 9 is short, unless a clearance 10 between the inside diameter of the dust discharge pipe 4 and the outside shape of the cylinder skirt 8 is small, a force for sucking dust in the cylinder bore 3 decreases. Also, in the case where the insertion length 9 is long, the movement distance of the cylinder 2 or the dust discharge pipe 4 increases, so that energy is wasted.

Figure 6A:
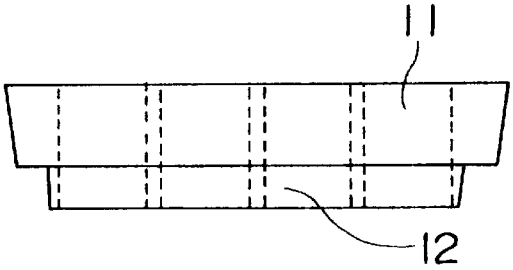
FIG. 6 is a schematic view of a multi-cylinder cylinder block, FIG. 6(*a*) being a side view thereof, and FIG. 6(*b*) being a bottom view thereof.
Figure 6B:
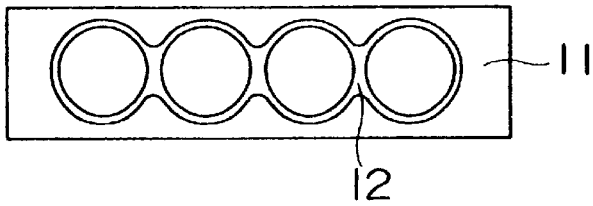

However, for only a limited engine having a single cylinder separate from a crankcase, the cylinder skirt 8 can be inserted in the dust discharge pipe 4. For a multi-cylinder cylinder block 11 separate from a crankcase, as shown in FIG. 6, since skirts 12 of cylinders connect with each other, the skirt 12 cannot be inserted in the dust discharge pipe 4 in a state in which the cylinders are separated.

Figure 7:
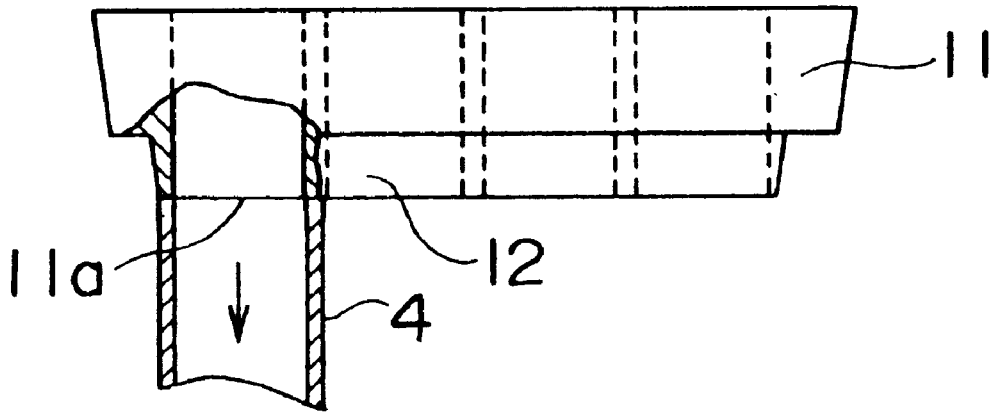
FIG. 7 is a schematic sectional view showing one example of a connection state of a cylinder and a suction port of dust discharge pipe in a case where a thermal spraying system for a cylinder in accordance with the present invention is applied to a multi-cylinder cylinder block.
Figure 8:
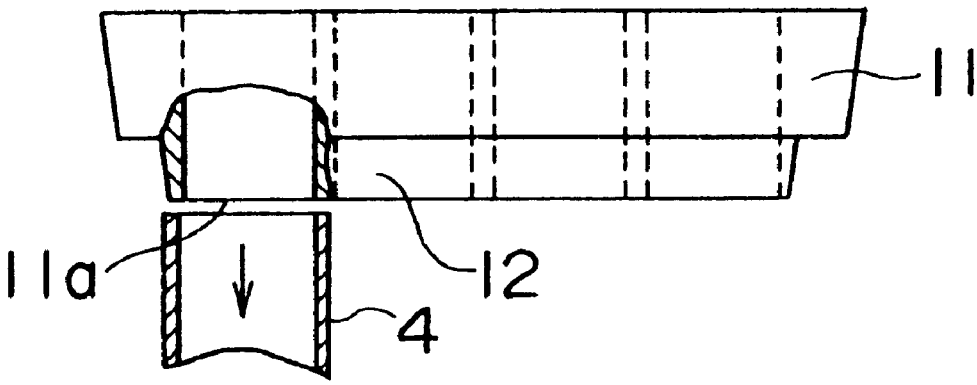
FIG. 8 is a schematic sectional view showing another example of a connection state of a cylinder and a suction port of a dust discharge pipe in a case where a thermal spraying system for a cylinder in accordance with the present invention is applied to a multi-cylinder cylinder block.

In the case of such a cylinder block 11, the dust discharge pipe 4 may be connected to a cylinder lower face 11*a* without being inserted in the skirt 12 as shown in FIG. 7, or may be located at a position a little distant from the cylinder lower face 11*a*. The distance by which the dust discharge pipe 4 is separated from the cylinder lower face 11*a* is not subject to any restriction because it depends on the capacity of a dust collector. However, it should preferably be about 1 mm. If the distance by which the dust discharge pipe 4 is separated from the cylinder lower face 11*a* is large, a suction force required in the cylinder bore cannot be obtained, or dust caused by thermal spraying leaks to the outside, resulting in wear.

Figure 9:
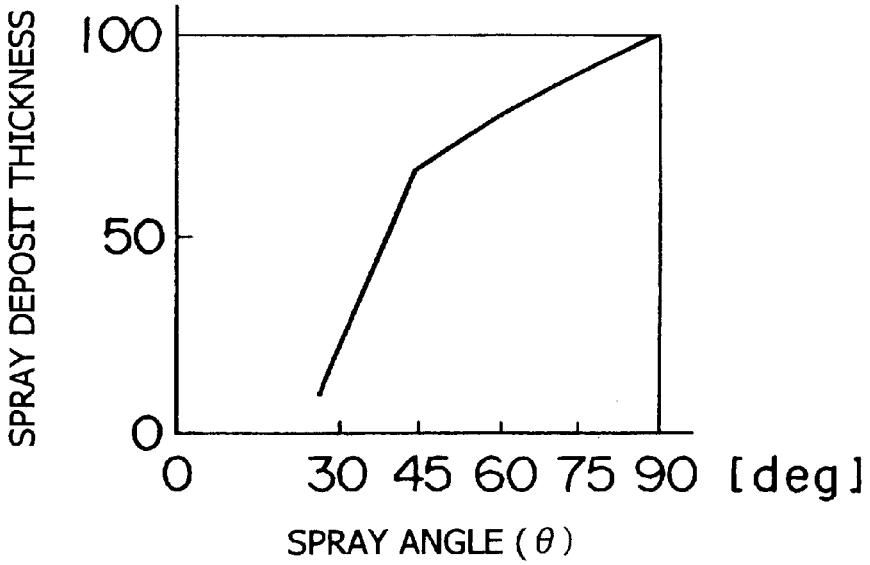
FIG. 9 is a graph showing a measurement result for a relationship between spray angle and spray deposit thickness obtained by using a thermal spraying system for a cylinder.
Figure 10:
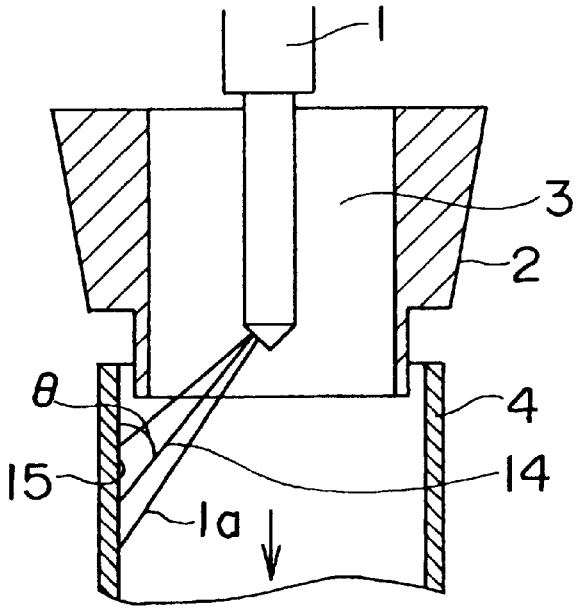
FIG. 10 is a sectional view showing a spraying state for explaining the graph of FIG. 9.

Angle Between Spray Flame and Inside Surface of Dust Discharge Pipe Suction Port:

FIG. 9 shows a measurement result for a relationship between the deposit thickness and the spray angle. From this graph, it can be seen that the deposit thickness decreases suddenly when the spray angle becomes 45 degrees or less. Although the spray flame 1*a* has a spread at a certain angle, when an angle θ (see FIG. 10) that the center axis 14 of the spray flame 1*a* makes with the inside surface 15 of the dust discharge pipe suction port 5 is less than 45 degrees, the deposition of the spray deposit 7 decreases.

There are available three types of bore spraying guns 1 that inject the spray flame 1*a* at an angle $\theta_1$ (see FIG. 11) of 45, 60 and 90 degrees. For each of these types, study is made on the case where the cylinder skirt 8 is inserted in the dust discharge pipe 4 and on the case where it is not inserted in the dust discharge pipe 4.

Figure 11:
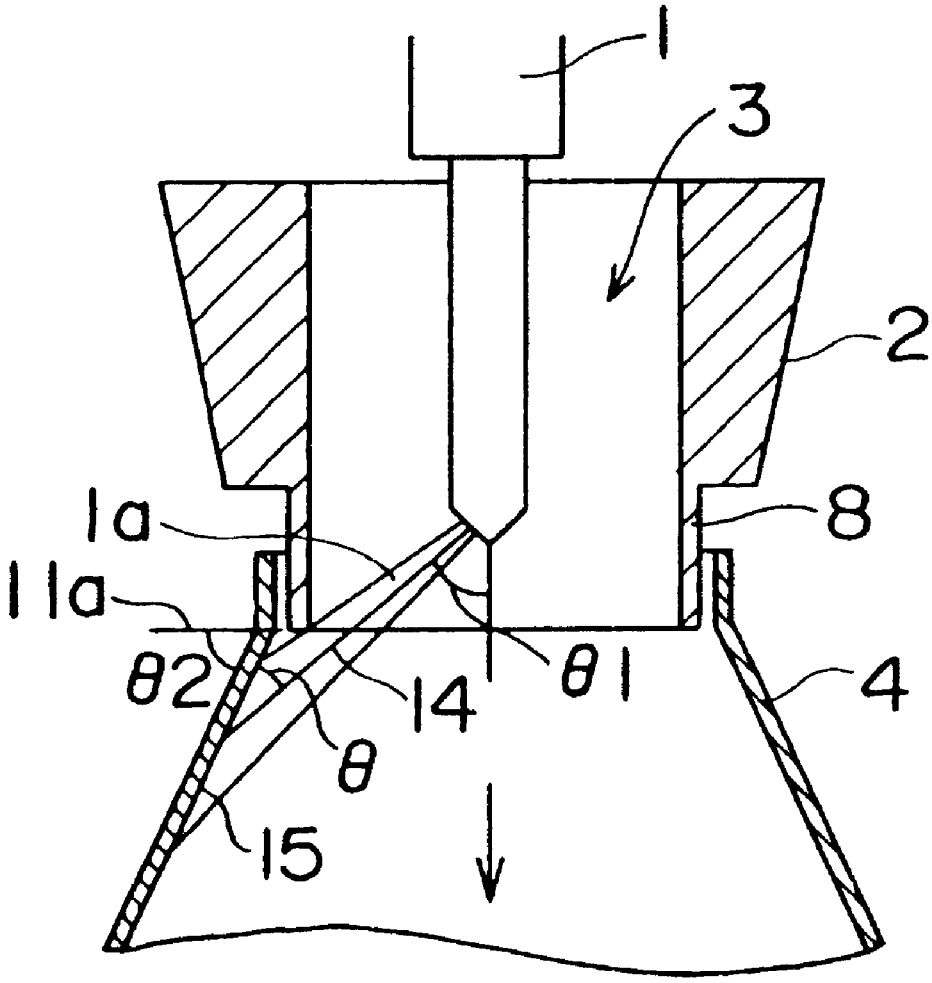
FIG. 11 is a schematic view showing a relationship between a lower end of a cylinder bore, a suction port of a dust discharge pipe, and spray flame in a thermal spraying system in accordance with the present invention.

Case Where Cylinder Skirt 8 is Inserted in Dust Discharge Pipe 4:

FIG. 11 shows a positional relationship between the angle $\theta_1$ at which the spray flame 1*a* injects and an angle $\theta_2$ that the cylinder lower face 11*a* makes with the inside surface 15 of the dust discharge pipe suction port 5.

In the case where the angle $\theta_1$ at which the spray flame 1*a* injects is 45 degrees, if the angle $\theta_2$ (see FIG. 11) that the cylinder lower face 11*a* makes with the inside surface 15 of the dust discharge pipe suction port 5 is 90 degrees and smaller, a good result can be obtained. If the angle $\theta_2$ is 45 degrees, the angle θ that the center axis 14 of the spray flame 1*a* makes with the inside surface 15 of the dust discharge pipe suction port 5 is 0 degrees, that is, the center axis 14 of the spray flame 1*a* is in parallel with the inside surface 15 of the dust discharge pipe suction port 5, so that the deposit 7 is scarcely formed. Also, if the angle $\theta_2$ is smaller than 45 degrees, the center axis 14 of the spray flame 1*a* is not in contact with the inside surface 15 of the dust discharge pipe suction port 5, so that the deposit 7 is not formed at all. Therefore, the angle $\theta_2$ that the cylinder lower face 11*a* makes with the inside surface 15 of the dust discharge pipe suction port 5 should preferably be $0° \leqq \theta_2 \leqq 90°$, and more preferably be $0° \leqq \theta_2 \leqq 45°$.

In the case where the angle $\theta_1$ at which the spray flame 1*a* injects is 60 degrees, if the angle $\theta_2$ that the cylinder lower face 11*a* makes with the inside surface 15 of the dust discharge pipe suction port 5 is 75 degrees and smaller, a good result can be obtained. If the angle $\theta_2$ is 30 degrees and smaller, the center axis 14 of the spray flame 1*a* is in parallel with or is not in contact with the inside surface 15 of the dust discharge pipe suction port 5, so that the deposit 7 is not formed. Therefore, the angle $\theta_2$ that the cylinder lower face 11*a* makes with the inside surface 15 of the dust discharge pipe suction port 5 should preferably be $0° \leqq \theta_2 \leqq 75°$, and more preferably be $0° \leqq \theta_2 \leqq 30°$.

Figure 12:
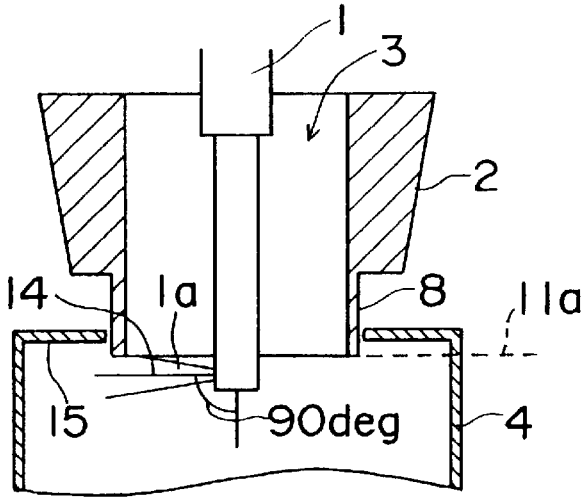
FIG. 12 is a schematic view showing a relationship between spray flame, a lower end of cylinder bore, and a suction port of a dust discharge pipe in the case where the spray angle is 90 degrees in a thermal spraying system in accordance with the present invention.

In the case where the angle $\theta_1$ at which the spray flame 1*a* injects is 90 degrees, if the angle $\theta_2$ that the cylinder lower face 11*a* makes with the inside surface 15 of the dust discharge pipe suction port 5 is 45 degrees and smaller, a good result can be obtained. In order to make the inside surface 15 of the dust discharge pipe suction port 5 in parallel with the spray flame 1*a* as in the cases of other types, the dust discharge pipe having the suction port 15 parallel with the cylinder lower face 11*a* must be prepared (FIG. 12).

Figure 13:
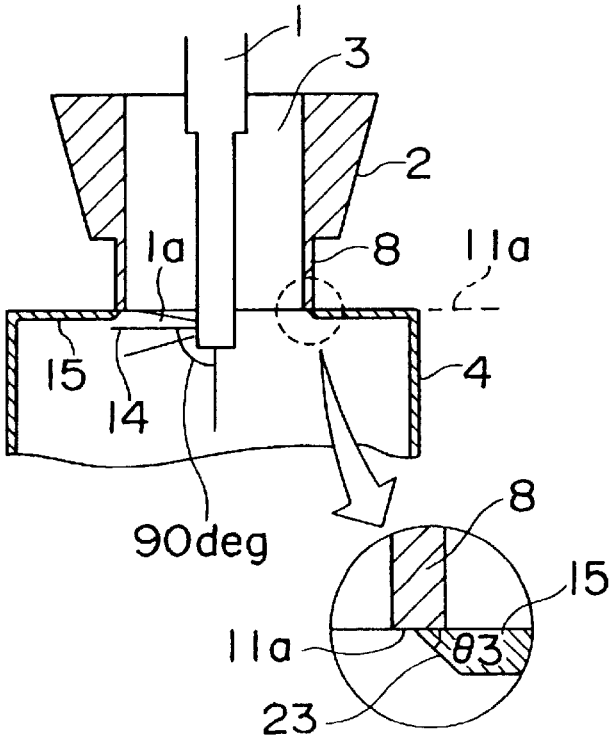
FIG. 13 is a schematic view showing a relationship between spray flame, a lower end of a cylinder bore, and a suction port of a dust discharge pipe in the case where the spray angle is 90 degrees in a thermal spraying system in accordance with the present invention.

In the Case Where the Cylinder Skirt 8 is not Inserted in the Dust Discharge Pipe 4:

The angle $\theta_2$ that the cylinder lower face 11*a* makes with the inside surface 15 of the dust discharge pipe suction port 5 is basically the same as that in the case where the cylinder skirt 8 is inserted in the dust discharge pipe 4. In the case where the angle $\theta_1$ at which the spray flame 1*a* injects is 90 degrees, in order to make the inside surface 15 of the dust discharge pipe suction port 5 in parallel with the center axis 14 of the spray flame 1*a*, the dust discharge pipe 4 having the suction port 15 parallel with the cylinder lower face 11*a* must be prepared. In this case, depending on the plate thickness or the end shape of the dust discharge pipe 4, the deposit 7 undesirably adheres to the end portion of the dust discharge pipe 4. In this case, therefore, as shown in FIG. 13, the end portion 23 of the dust discharge pipe 4 should preferably have a bevel angle $\theta_3$ such that $\theta_3 \leqq 45°$.

Rotation of Dust Discharge Pipe:

In the Case of Thermal Spraying of Cylinder Using a Turntable:

In the case where thermal spraying of a cylinder is accomplished while the cylinder is rotated by using a turntable and the thermal spraying gun is not rotated, if the dust discharge pipe is not rotated, the spray flame is applied to only the same place of the dust discharge pipe, so that the discharge pipe becomes hot and is melted, or remarkable deposition of spray deposit forms a portion that obstructs air flow, thereby producing a turbulent flow in the dust discharge pipe to degrade the deposit property. Therefore, the dust discharge pipe must be rotated.

However, the dust discharge pipe, which must be connected to the dust collector or an exhaust fan, must be provided with a portion that does not rotate.

Thereupon, the dust discharge pipe 4 is preferably made up of two divided portions: a rotating portion 17 to which the spray flame 1*a* is applied and a fixed portion 18 which is connected to the dust collector or the like.

Figure 14A:
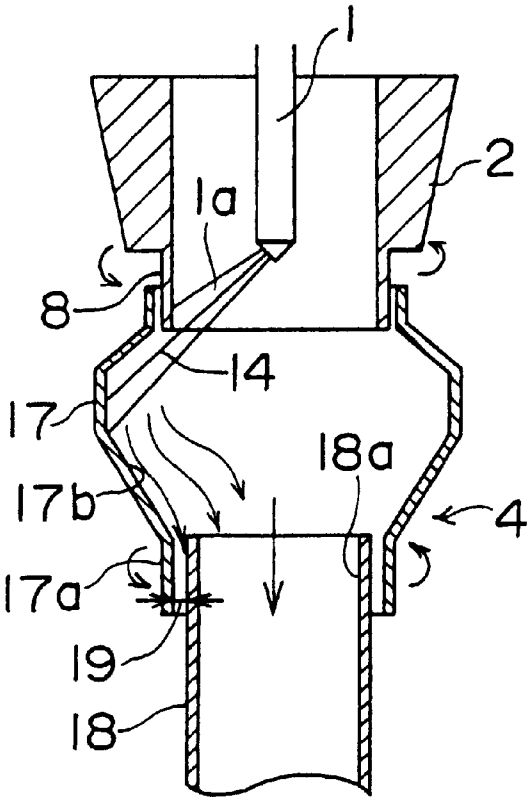
FIG. 14 is a schematic sectional view showing modes of connecting construction in a case where a dust discharge pipe is made up of a rotating portion and a fixed portion in a thermal spraying system in accordance with the present invention, FIGS. 14(*a*), 14(*b*) and 14(*c*) showing each of the modes.
Figure 14B:
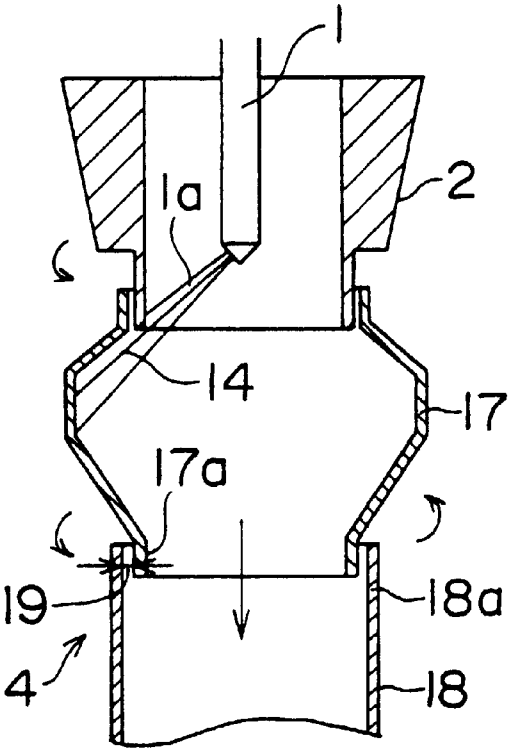
Figure 14C:
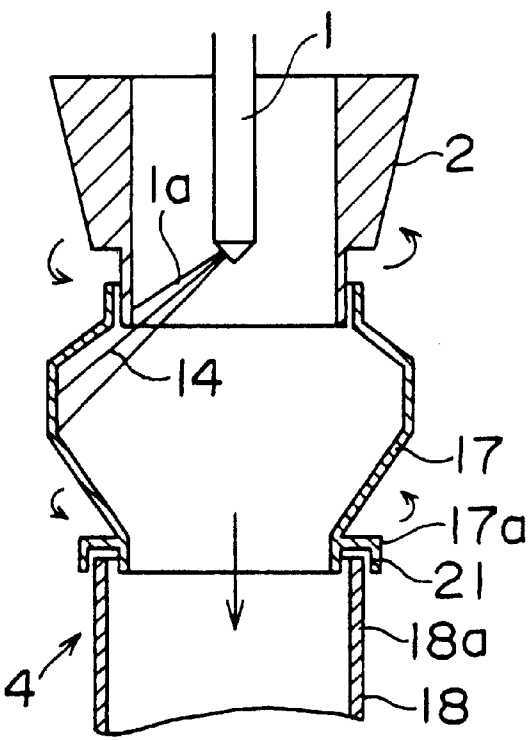

FIG. 14 shows connecting constructions of the rotating portion 17 and the fixed portion 18 in this case.

FIG. 14(*a*) shows a case where the pipe diameter of a lower end part 17*a* of the rotating portion 17 is larger than the pipe diameter of an upper end part 18*a* of the fixed portion 18. In this case, the suction force does not decrease, but some of the flame 1*a* hitting an inside surface 17*a* of the rotating portion 17 sometimes comes down along the inside surface 17*a* and is discharged to the outside through a clearance 19 between the lower end part 17*a* of the rotating portion 17 and the upper end part 18*a* of the fixed portion 18. This leads to clogging of the clearance 19 with spray powder or spray deposit 7, so that the rotation of the rotating portion 17 of the dust discharge pipe 4 may be hindered.

FIG. 14(*b*) shows the case where the pipe diameter of the lower end part 17*a* of the rotating portion 17 is smaller than the pipe diameter of the upper end part 18*a* of the fixed portion 18. In this case, the spray flame 1*a* is not discharged to the outside of pipe, but the outside air is liable to be sucked through the clearance 19 between the lower end part 17*a* of the rotating portion 17 and the upper end part 18*a* of the fixed portion 18, so that the suction force may decrease.

FIG. 14(*c*) shows the case where considering the above problems, a concave 21 is formed at the lower end part 17*a* of the rotating portion 17, and the upper end part 18*a* of the fixed portion 18 is fitted in the concave 21 with a clearance. If the concave is formed not at the rotating portion 17 but at the upper end part 18*a* of the fixed portion 18, the spray flame 1*a* hits the concave to form a deposit therein. Therefore, the concave should preferably be formed at the rotating portion 17.

Although the clearance 19 is formed between the lower end part 17*a* of the rotating portion 17 and the upper end part 18*a* of the fixed portion 18 in FIG. 14, a bearing or other driving units may be provided therebetween. In the cases of FIGS. 14(*a*) and 14(*b*), however, the bearing or other driving units may be exposed to dust, and are exposed to heat. Therefore, it is preferable that the clearance 19 be provided without the use of the bearing or other driving units.

Figure 15:
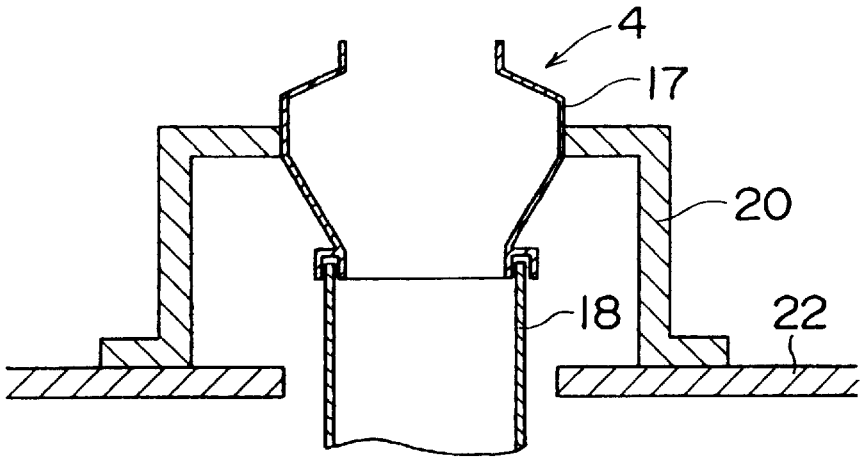
FIG. 15 is a schematic sectional view showing a connection state of a rotating portion of dust discharge pipe and a turntable in a thermal spraying system in accordance with the present invention.

Also, although various modes of method for rotating the rotating portion 17 of the dust discharge pipe 4 can be used, a mode is preferable in which as shown in FIG. 15, an arm is provided so as to extend upward from a turntable 22, and the rotating portion 17 is integrally held by the tip end of the arm 20 to rotate the rotating portion 17 by utilizing the rotation of the turntable 22.

Also, the temperature of the fixed portion 18 of the dust discharge pipe 4 is liable to be increased by the hot dust passing along the inside surface. Therefore, it is preferable that as shown in FIG. 16, a rotating shaft 39 for the turntable 22 be formed into a cylindrical shape, and the dust discharge pipe 4 be provided in the rotating shaft 39 with a space 38 provided between the dust discharge pipe 4 and the rotating shaft 39.

Specifically, the turntable 22 is formed into a ring shape (having a hole in the center), and the dust discharge pipe 4 is provided in the center of rotation with the space 38 provided between the turntable 22 and the dust discharge pipe 4. Since the dust discharge pipe 4 for causing dust having become hot during thermal spraying to flow is subjected to a high temperature, if the dust discharge pipe 4 is in contact with the turntable rotating shaft 39, the heat of the dust discharge pipe 4 is transmitted to the rotating shaft 39, which accelerates deterioration of bearing grease or deterioration of sealing material 40 for isolating an air supply/discharge passage at the outer periphery of the turntable rotating shaft 39.

Figure 16:
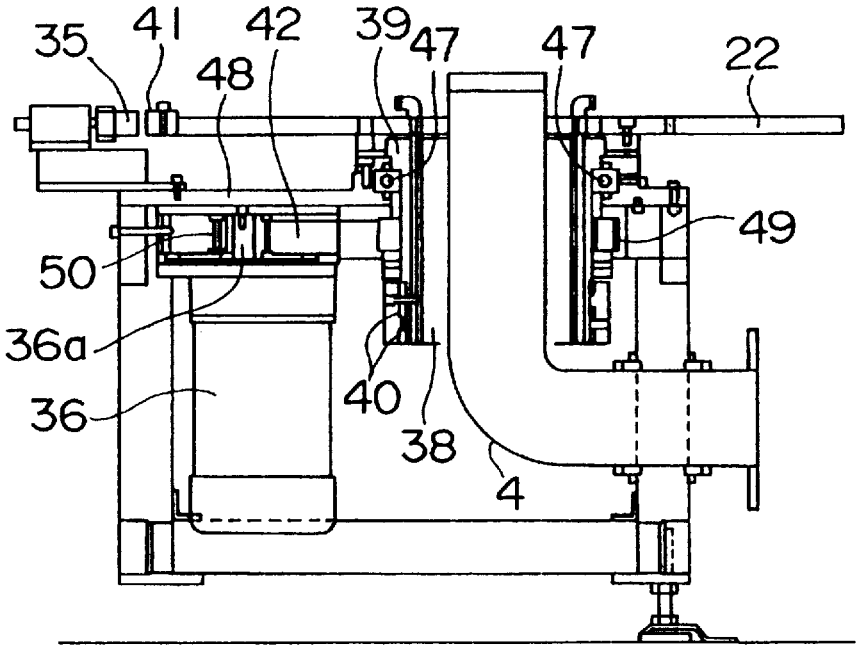
FIG. 16 a sectional view showing a relationship between a rotating shaft of turntable and a dust discharge pipe in a thermal spraying system in accordance with the present invention.

The rotating shaft 39 for the turntable 22 shown in FIG. 16 is supported on a frame 48 via a bearing 47 so as to be rotatable. The rotating shaft 39 is provided with a pulley 49, and the pulley 49 is connected to a driving shaft 36*a* of a motor 36 via a belt 42 and a pulley 50.

Figure 17:
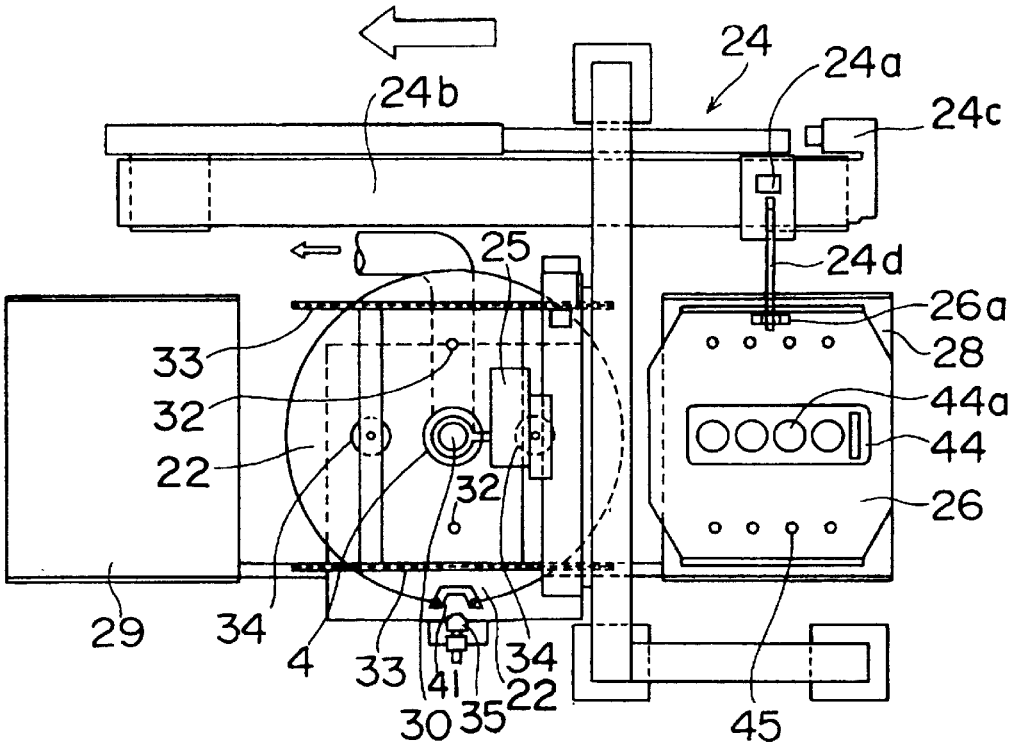
FIG. 17 is a plan view showing a mechanism for positioning and locking a cylinder conveying pallet on a turntable in a thermal spraying system in accordance with the present invention.
Figure 18:
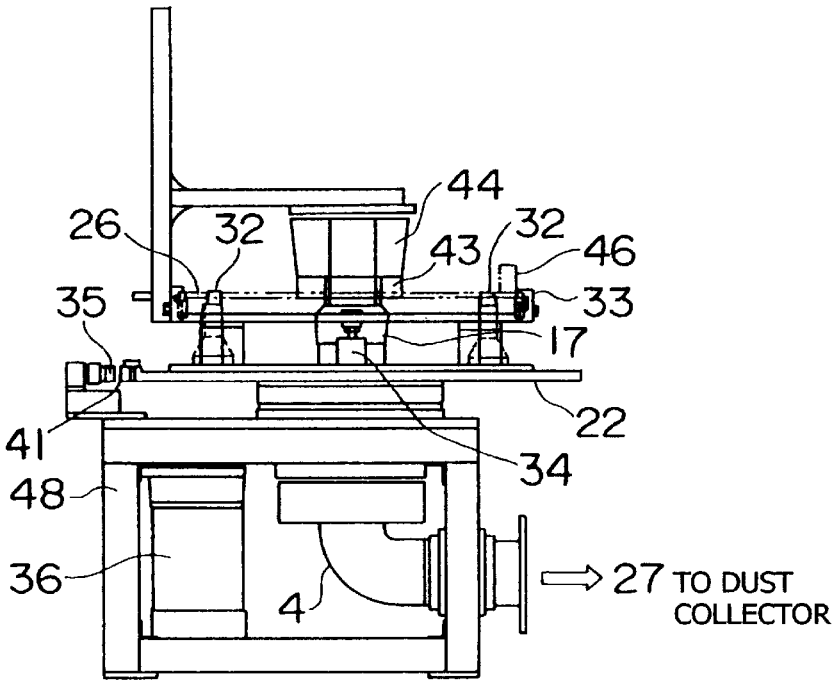
FIG. 18 is a side view showing a mechanism for positioning and locking a cylinder conveying pallet on a turntable in a thermal spraying system in accordance with the present invention.

Positioning/Clamping Mechanism for Cylinder:

In the case where thermal spraying of a cylinder is accomplished by using the turntable 22 in mass production, cylinders flowing one after another must be positioned accurately and clamped with durability. FIGS. 17 and 18 show a cylinder positioning/clamping mechanism.

On the turntable 22, two positioning pins 32 are erected at positions in a direction perpendicular to the cylinder transfer direction (the arrow-marked direction in FIG. 17) on the opposite sides of the dust discharge pipe 4. Also, on the top surface of the turntable 22, two cylinders 34 are provided in the cylinder transfer direction on the opposite sides of the dust discharge pipe 4, and U-shaped rails 33 extending in the cylinder transfer direction are fixed to piston rods of the air cylinders 34. The rails 33 have a U-shape in their cross section so that both ends of a pallet can be retained by the rails 33.

On the other hand, the frame 48 is provided with a pallet carrying-in guide rollers 28 and a pallet carrying-out guide rollers 29 on the opposite sides of the turntable 22. Although, it is not clear in the drawings, the guide rollers 28 and 29 are configured with a number of rollers which are arranged in parallel so that a pallet can be carried out.

Also, at the side of the pallet carrying-in guide rollers 28 and the pallet carrying-out guide rollers 29, a guide member 24*b* is provided to move a table 24*a* of a pallet moving robot 24 between positions corresponding to the guide rollers 28 and 29, and the table 24*a* is moved along the guide member 24*b* by a motor 24*c*. Also, the table 24*a* has a connecting bar 24*d* whose tip end moves vertically.

A cylinder 44 is set on a cylinder conveying pallet 26 via a cylinder mount 43, and the pallet 26 is set on the pallet carrying-in guide rollers 28. The pallet 26 is engaged with the table 24*a* of the robot 24 by lowering the tip end of the connecting bar 24*d*, and is transferred to the U-shaped rails 33 by operating the motor 24*c*.

The pallet 26 transferred to the U-shaped rails 33 is lowered by operating the air cylinders 34, and is positioned by fitting pallet positioning holes 45 formed in the pallet 26 on the positioning pins 32. The pallet positioning holes 45 are formed so as to correspond to bores 44*a* of the cylinder 44.

Therefore, highly accurate positioning can be performed. Thereby, even when the inside diameter of the cylinder bore 44*a* is small, a thermal spraying gun 30 is positioned without contacting with the peripheral surface of the bore 44*a*.

Also, in this cylinder positioning mechanism, a key groove 41 is formed in the turntable 22 so that the turntable 22 always stops at a fixed position, and a turntable stop position determining key 35 is disposed at the periphery of the turntable 22.

Thereupon, the turntable 22 is always stopped at the fixed position by the insertion of the key 35 in the key groove 41 formed in the turntable 22.

Therefore, the cylinder bores 44*a* on the turntable 22 are always positioned along the cylinder transfer direction, and the bore 44*a* can be positioned easily merely by moving the pallet 26 by a bore pitch.

Also, since the turntable 22 rotates in a horizontal state, the cylinder 44 and the pallet 26 are subjected to a transverse force by the centrifugal force. However, the transverse force of the cylinder 44 is restrained by the insertion of the positioning pins 32 in the pallet 26. Further, since the positioned pallet 26 lies in the U-shaped rails 33, the vertical movement is also restrained.

Also, a portion to which the highest force is applied by the clamping of the pallet 26 is the positioning pin 32 on the turntable 22. Since the durability can be changed by the thickness of the pin and the pin can be replaced easily, both of the durability and maintainability are sufficient.

In FIG. 17 (and FIG. 18), a reference numeral 25 denotes a robot for moving the thermal spraying gun 30. The robot 25 holds the thermal spraying gun 30 over the center of the turntable 22, and moves the thermal spraying gun 30 vertically.

After the thermal spraying operation for the cylinder 44 is finished, the pallet 26 for the cylinder 44 is transferred to the pallet carrying-out guide rollers 29 by the motor 24*c*.

Figure 19:
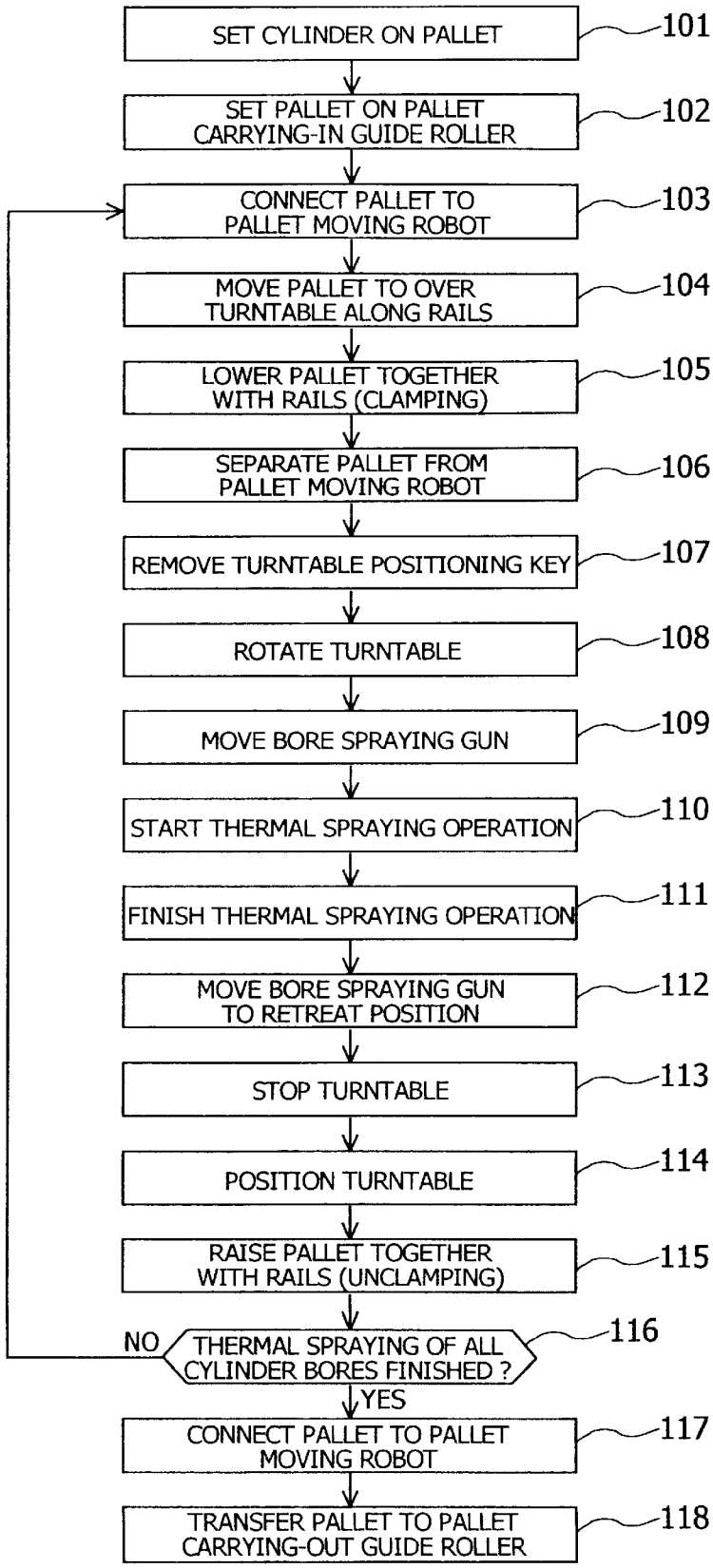
FIG. 19 is a flowchart showing a manufacturing process for a cylinder subjected to thermal spraying by using a thermal spraying system for a cylinder in accordance with the present invention.

The manufacturing process for a cylinder subjected to thermal spraying by using the above-described thermal spraying system for a cylinder will be explained with reference to a flowchart shown in FIG. 19.

First, the cylinder 44 having been subjected to blasting is set on the pallet 26 (Step 101). At this time, the cylinder 44 is set so that the bores 44*a* thereof are arranged in line in the cylinder transfer direction. The configuration is such that when the cylinder 44 is set, the bores 44*a* of the cylinder 44 and the holes 45 formed in the pallet 26 correspond to each other.

Next, the cylinder conveying pallet 26 is set on the pallet carrying-in guide rollers 28 (Step 102).

Thereafter, the connecting lever 24*d* is lowered from the table 24*a* of the pallet moving robot 24 to connect the table 24*a* to the pallet 26 via a connecting lever insertion jig 26*a* provided on the cylinder conveying pallet 26 (Step 103).

Next, by operating the motor 24*c*, the cylinder conveying pallet 26 is moved to a spray position over the turntable 22 for thermal spraying of a cylinder through the U-shaped rails 33 (Step 104). The spray is a position at which the center of the cylinder bore to be subjected to thermal spraying coincides with the center of rotation of the turntable 22.

Thereafter, the cylinder conveying pallet 26 is lowered integrally with the U-shaped rails 33, and the positioning pins 32 set on the turntable 22 and the rotating portion 17 of the dust discharge pipe 4 located at the center of the turntable 22 are connected, by which the pallet 26 is clamped (Step 105). Thereby, the dust discharge pipe 4, the pallet 26, and the cylinder bore 44*a* are connected to each other, providing one substantially continuous pipe. During the thermal spraying operation, spray dust is sucked efficiently by operating a dust collector 27 connected to the dust discharge pipe 4, so that dust does not scatter.

Next, the connecting bar 24*d* having been connected to the cylinder conveying pallet 26 is raised to separate the cylinder conveying pallet 26 from the pallet moving robot 24 (Step 106). By the separation, the turntable 22 and the pallet 26 can be rotated independently of the pallet moving robot 24.

Thereafter, the turntable stop position determining key 35 is removed from the turntable 22 (Step 107).

Next, the cylinder conveying pallet 26 is rotated integrally with the turntable 22 (Step 108). The vertical movement of the pallet 26 is restricted by the U-shaped rails 33, and the transverse movement thereof is restricted by the positioning pins 32. Therefore, the pallet 26 is clamped firmly, so that even if a cylinder for a four-wheel vehicle weighing 20 kg was rotated at a rotational speed of 100 rpm, the cylinder 44 and the pallet 26 did not fly off.

Subsequently, the bore spraying gun 30 fixed to the thermal spraying gun moving robot 25 is moved to a position for thermal spraying of the rotating cylinder, by which thermal spraying operation is started (Step 110). During the thermal spraying operation, dust in the bore is continuously collected by the dust collector 27.

After the thermal spraying operation is finished (Step 111), the bore spraying gun 30 is moved to a retreat position by the thermal spraying gun moving robot 25, and the turntable 22 is stopped (Step 113). When the turntable is stopped, the turntable stop position determining key 35 is inserted, so that the turntable 22 is always stopped so as to face to the same direction (Step 114). Accordingly, the pallet 26 positioned on the turntable 22 also faces always to the fixed direction. Therefore, the connecting lever 24*d* extending from the pallet moving robot 24 can be inserted in the connecting lever insertion jig 26*a* on the pallet 26.

Next, the cylinder conveying pallet 26 rises integrally with the U-shaped rails 33, and is separated from the positioning pins 32 and the rotating portion 17 of the dust discharge pipe 4, so that the pallet 26 is unclamped (Step 115).

Judgement is made whether or not there is still a bore to be subjected to thermal spraying on the cylinder 44 set on the cylinder conveying pallet 26, that is, whether or not the thermal spraying of all cylinder bores has been finished (Step 116). If the judgement result is No, the pallet 26 is moved by the pallet moving robot 24 so that the bore to be subjected to thermal spraying next comes to the center of rotation, and is clamped (Step 103). The above-described operation is repeated.

Thus, the bores are subjected to thermal spraying successively. After the thermal spraying of all of the bores has been finished, the pallet 26 is unclamped. The cylinder conveying pallet 26 is connected to the pallet moving robot 24 (Step 117), and is transferred to the pallet carrying-out guide rollers 29 (Step 118). Thereafter, the next pallet is used for thermal spraying of cylinder.

WORKING EXAMPLE

In the above-described thermal spraying operation for a cylinder, the adhesion to the dust discharge pipe was examined. In an experiment, adhesion was determined in the case where the single cylinder skirt was inserted in the dust discharge pipe, and in the case where a cylindrical dust discharge pipe with an inside diameter was equal to the cylinder inside diameter.

Experimental Conditions:

Thermal spraying method Plasma thermal spraying
Spray angle 45 degrees
Supply current 800 A
Main gas flow rate (Ar) 56.8 liters/min
Auxiliary gas flow rate (He) 7.6 liters/min
Powder supply gas flow rate (Ar) 5.3 liters/min
Thickness of deposit formed by one process 200 $\mu$m
Number of cylinders subjected to thermal spraying 12

On the dust discharge pipe of this example, a deposit was scarcely formed. Also, the deposit was a sound one that scarcely has pores therein. Also, in the thermal spraying of twelve cylinders, the positioning and clamping mechanism for a cylinder fulfilled a sufficient function.

On the other hand, in the case where a cylindrical dust discharge pipe with an inside diameter equal to the cylinder inside diameter was used, on the fifth cylinder, the deposit on the dust discharge pipe connected with the deposit on the cylinder, so that when the cylinder was removed, the deposit thereon was peeled off.

From the above result, it can be seen that the shape of the dust discharge pipe has an influence on the deposit property. Also, it is found that the use of the dust discharge pipe in accordance with the present invention decreases the deposit formed on the dust discharge pipe, and thereby the dust discharge pipe need not be replaced, so that a mass production effect can be achieved, and also a stable spray deposit can be formed.

Although the present invention has been described with reference to the embodiments shown in the drawings, it is not limited to these embodiments. All modifications, changes, and additions that are easily made by a person skilled in the art are embraced in the technical scope of the present invention.

The disclosure of Japanese Patent Application 2000-185542 filed on Jun. 21, 2000 including the specification, the claims, the drawings, and the abstract is incorporated herein by reference with its entirety.

What is claimed is:

1. A thermal spraying system for a cylinder, comprising:

a cylinder rotatably mounted on a turntable so that a bore inside surface of said cylinder is subjected to thermal spraying by moving a thermal spraying gun in the axial direction in the bore of said cylinder while said cylinder is rotated; and a suction port of a dust discharge pipe for sucking dust in the bore of said cylinder disposed under said cylinder to suck and discharge dust in the bore of said cylinder, wherein the diameter of the suction port of said dust discharge pipe is larger than the inside diameter of the bore of said cylinder; and wherein said dust discharge pipe is divided into a rotating portion and a fixed portion, and said rotating portion is held integrally with said turntable and is inserted in said fixed portion with a gap therebetween.

2. The thermal spraying system for a cylinder according to claim 1, wherein an angle between the center axis of spray flame injected from said thermal spraying gun and said dust discharge pipe is 45 degrees or less.

3. The thermal spraying system for a cylinder according to claim 1, wherein a rotating shaft of said turntable is formed of a tube, and said dust discharge pipe is disposed in said rotating shaft with a gap therebetween.

4. A thermal spraying system for a cylinder, comprising:

a cylinder rotatably mounted on a turntable so that a bore inside surface of said cylinder is subjected to thermal spraying by moving a thermal spraying gun in the axial direction in the bore of said cylinder while said cylinder is rotated; and a suction port of a dust discharge pipe for sucking dust in the bore of said cylinder disposed under said cylinder to suck and discharge dust in the bore of said cylinder, wherein the diameter of the suction port of said dust discharge pipe is larger than the inside diameter of the bore of said cylinder, and wherein:

said cylinder is fixed to a pallet, said pallet is conveyed and fixed to said turntable;

said cylinder is rotated together with said pallet;

U-shaped rails for guiding said pallet are provided in parallel above said turntable so as to be movable vertically; and protrusions are erected on said turntable and holes are formed in said pallet;

so that said pallet to which said cylinder is fixed is guided by said U-shaped rails and said U-shaped rails are lowered to fit the holes formed in said pallet on said protrusions provided on said turntable;

whereby said cylinder is positioned and locked on said turntable.

* * * * *